US006317944B1

(12) United States Patent
Beaulieu et al.

(10) Patent No.: US 6,317,944 B1
(45) Date of Patent: Nov. 20, 2001

(54) SHIPPING PACKAGE FOR CASKET FOLDERS

(75) Inventors: Benoît M. Beaulieu, Squatec; Guillaume Michaud, Sherbrooke; Jocelyn Ouellet, Saint-Juste-du-Lac, all of (CA)

(73) Assignee: Cercueils Alliance Caskets Inc., Edmundston (CA)

( * ) Notice: Subject to any disclaimer, the term of this patent is extended or adjusted under 35 U.S.C. 154(b) by 0 days.

(21) Appl. No.: 09/420,427

(22) Filed: Oct. 19, 1999

(51) Int. Cl.[7] ..... A61G 17/00
(52) U.S. Cl. ..... 27/4; 27/35
(58) Field of Search ..... 27/2, 4, 35; 220/4.28, 220/6; 229/939; 53/458; 206/736

(56) References Cited

U.S. PATENT DOCUMENTS

| | | | | |
|---|---|---|---|---|
| 3,574,906 | | 4/1971 | Rittenhouse . | |
| 3,729,786 | | 5/1973 | Walding . | |
| 3,782,619 | * | 1/1974 | Dittbenner | 27/35 X |
| 3,955,252 | | 5/1976 | Reda . | |
| 4,063,337 | | 12/1977 | Havey, III . | |
| 4,139,918 | * | 2/1979 | Covington | 27/28 X |
| 4,151,630 | | 5/1979 | Havey . | |
| 4,156,956 | | 6/1979 | Partridge . | |
| 4,176,431 | | 12/1979 | Havey . | |
| 4,399,596 | | 8/1983 | Parlour . | |
| 4,800,631 | * | 1/1989 | Pellmann | 27/2 X |
| 5,035,032 | | 7/1991 | Nutting . | |
| 5,307,545 | | 5/1994 | Stoltz . | |
| 5,353,484 | | 10/1994 | Woedl . | |
| 5,586,679 | | 12/1996 | Thomas . | |
| 5,661,879 | | 9/1997 | Kelly . | |
| 5,771,548 | * | 6/1998 | Jenkins | 27/2 |
| 5,775,061 | | 7/1998 | Enneking . | |
| 5,815,898 | * | 10/1998 | Jenkins | 27/4 |
| 5,862,847 | * | 1/1999 | Jenkins | 27/4 X |
| 5,915,680 | | 6/1999 | Umemura . | |
| 5,960,978 | * | 10/1999 | Jenkins | 27/4 X |

* cited by examiner

*Primary Examiner*—Lynne H. Browne
*Assistant Examiner*—William L. Miller
(74) *Attorney, Agent, or Firm*—Mario Theriault

(57) ABSTRACT

There is provided a shipping package for casket folders, comprising a pair of casket-base folders each having stocky and stiff edges bordering the inside side of each folder. The casket-base folders are positioned against each other with their inside sides facing each other. The inside sides and the stocky edges of both casket-base folders define a hollow space, in which there are enclosed a pair of casket-cover folders and a pair of pressed casket-interior liner cloths. The casket-interior liner cloths are attached to liner-cloth stretchers which are affixed to one of the casket-base folders. A pair of oblong boxes enclose the ends of the casket-base folders and extend over a portion of the juxtaposed stocky edges. The shipping package is advantageous for affording a firm handling thereof and for its ability to retain the casket-interior liner cloths in a pleated, wrinkle-free condition until the package is opened again at destination.

20 Claims, 3 Drawing Sheets

SHIPPING PACKAGE FOR CASKET FOLDERS

FIELD OF THE INVENTION

The present invention relates to packages for shipping cardboard caskets and cremation boxes, and more particularly, the present invention pertains to a shipping package comprising at least a pair of flat casket kits in which the casket-interior liner cloths are maintained in a pleated and wrinkle-free condition.

BACKGROUND OF THE INVENTION

Cardboard caskets and cremation boxes are commonly shipped to funeral parlors in flat configurations, to save on transport costs and storage space. These caskets and boxes are assembled and formed by the funeral director's personnel as needed.

A number of methods and packages have been used in the past to ship cardboard caskets and cremation boxes in a configuration which requires minimum space. A common requirement regarding the shipping of caskets and cremation boxes in a flat configuration is that the casket components such as the handles, corpse supporting and positioning accessories and the interior liner cloth should be included within the package, to form a complete kit. Also, the shipping of caskets and cremation boxes in a flat configuration preferably requires that the package be sturdy enough to afford a firm handling without causing the components to becoming loose, separated, deteriorated or damaged.

In regard to prior developments in this field, the following US Patents illustrate and describe various cardboard caskets and cremation boxes that are shippable in a flat or collapsed configuration. U.S. Pat. No. 3,574,906 issued to Richard Rittenhouse, on Apr. 13, 1971; U.S. Pat. No. 3,729,786 issued to Rowland Trevor Walding, on May 1, 1973; U.S. Pat. No. 4,063,337 issued to Ambrose S. Havey, III, on Dec. 20, 1977; U.S. Pat. No. 4,151,630 issued to Ambrose S. Havey, on May 1, 1979; U.S. Pat. No. 4,156,956 issued to Roger J. Partridge et al., on Jun. 5, 1979; U.S. Pat. No. 4,176,431 issued to Ambrose S. Havey, III, on Dec. 4, 1979; U.S. Pat. No. 4,399,596 issued to Henry W. Parlour et al., on Aug. 23, 1983; U.S. Pat. No. 5,035,032 issued to Donald W. Nutting, on Jul. 30, 1991; U.S. Pat. No. 5,307,545 issued to Dennis J. Stoltz, on May 3, 1994; U.S. Pat. No. 5,353,484 issued to Stephen D. Woedl et al., on Oct. 11, 1994; U.S. Pat. No. 5,586,679 issued to Betty M. Thomas, on Dec. 24, 1996; U.S. Pat. No. 5,661,879 issued to Dean A. Kelly, on Sep. 2, 1997; U.S. Pat. No. 5,775,061 issued to John R. Enneking et al., on Jul. 7, 1998; U.S. Pat. No. 5,915,680 issued to Izuru Umemura et al., on Jun. 29, 1999.

Although the shipping methods and packages of the prior art have respective advantages and deserve undeniable merits, these packages and methods are believed to be inadequate with regards to preserving the product quality during transport of the casket or cremation box from the manufacturer's plant to the funeral director's establishment. For example, the prior art packages are believed to be inadequate for preserving the interior liner cloth against shuffling and ruffling during transport and handling thereof, especially when the packages are stacked on their edges.

Also, whether these casket kits are shipped in batches or as a single unit, each batch or unit is generally tied with straps. Edge protectors are normally used with tie straps. However, it is known that these edge protectors often slip off from under the straps during transport and handling. Consequently, it is quite common to observe strap marks and associated quality defects along the edges of cardboard caskets that are shipped by trucks or trains.

As such, it will be appreciated that there continues to be a need for a shipping package for cardboard casket folders and cremation box folders whereby the quality of the casket or cremation box and all of its components are preserved during transport from the manufacturer's facility to the purchaser's funeral parlor.

SUMMARY OF THE INVENTION

The present invention provides for a sturdy package for shipping cardboard casket kits while preserving the quality of the product and all of its components after final inspection and packaging by the manufacturer, and until delivery to the purchaser's funeral parlor or warehouse.

In accordance with one aspect of the present invention, there is provided a shipping package for casket folders, comprising a pair of casket-base folders each having stocky and stiff edges bordering the inside side of each folder. The casket-base folders are positioned against each other with their inside sides facing each other and with the edges of one casket-base folder being juxtaposed and aligned with the opposite edges of the other casket-base folder. The inside sides and the stocky edges of both casket-base folders define a hollow space therebetween, in which there are enclosed a pair of casket-cover folders and a pair of pleated and pressed casket-interior liner cloths. The casket-interior liner cloths are attached to liner-cloth stretchers which are affixed to the casket-base folders. A pair of oblong boxes enclose the ends of the casket-base folders and extend over a portion of the juxtaposed stocky edges.

The shipping package according to this aspect of the present invention is advantageous for providing substantial strength in resisting firm handling thereof and for its ability to retain the casket-interior liner cloths in a pleated and wrinkle-free condition until the package is opened again at destination.

In accordance with another aspect of the present invention, the surface of the shipping package has semicircular handle openings therein, and each of the semicircular handle openings has a straight segment bordering one of the stocky edges. The position of these handles is advantageous for inciting the handling of the shipping package by one of the stiff and stocky edges for preserving the quality of the shipping package and of the casket kits contained therein.

In accordance with yet another aspect of the present invention, there are provided strips of mating and gripping material along the stocky edges for retaining the stocky edges together when a pair of casket-base folders are laid against each other. This assembly provides for a shipping package that has strong laminated-like edges to resist deformation associated with repeated rugged manipulations.

The use of strips of gripping and mating material along the stocky edges, for retaining two casket-base folders against each other, is also advantageous during the assembly of the shipping package at the manufacturing plant. The retention of both casket-base folders together is advantageous for affording the turning of the pair of casket kits upside down or edge to edge, during the attachment of the oblong boxes thereon for example, without causing any ruffling of the casket-interior liner cloths contained therein.

In yet another aspect of the present invention, each casket-base folder has a central crease-free portion, and each oblong box has a longitudinal dimension relative to the shipping package, which is equal to or smaller than the width of the central crease-free portion. Each oblong box is thereby usable in a flat form as a casket bottom liner, in order to reduce waste associated with this shipping package.

Furthermore, each liner-cloth stretcher is made of two symmetrical segments which are detachably connected to each other. Each segment has slots, tabs, and bending lines therein to afford a folding thereof into an alternate form which is usable as a casket accessory, in order to also reduce waste associated with the shipping package.

Still another feature of the shipping package of the present invention is that it is susceptible of a low cost of manufacture with regard to materials, equipment and labour, and which accordingly is then susceptible of low price of sale to the funeral industry.

Other advantages and novel features of the invention will become apparent from the following detailed description.

BRIEF DESCRIPTION OF THE DRAWINGS

A preferred embodiment of a casket shipping package according to the present invention and some preferred components thereof will now be described with reference to the accompanying drawings in which.

DETAILED DESCRIPTION OF THE PREFERRED EMBODIMENT

Figure 1:
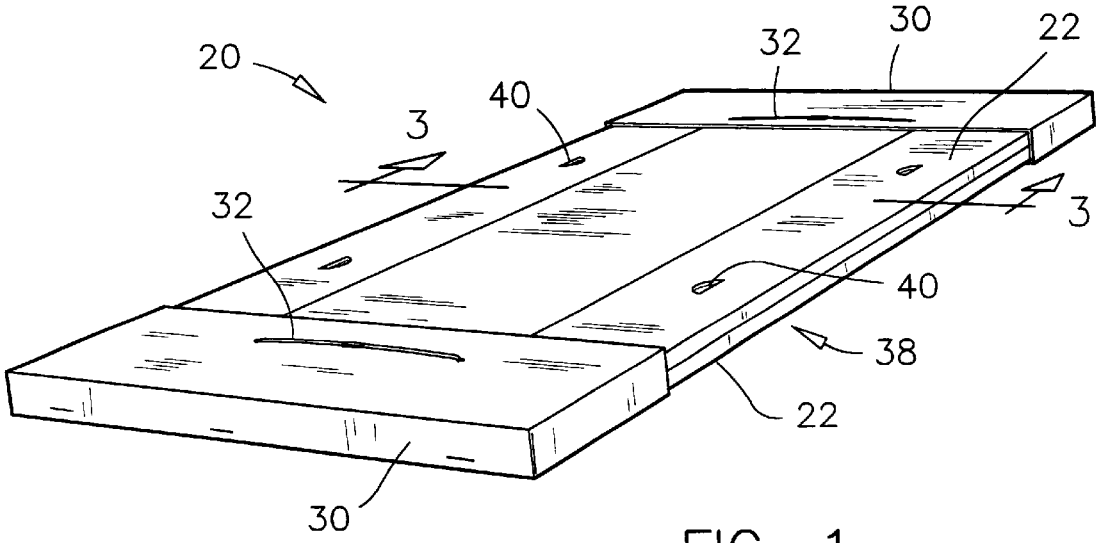
FIG. 1 illustrates a shipping package according to the preferred embodiment of the present invention comprising a pair of cardboard casket kits.

While this invention is susceptible of embodiments in many various forms, there is shown in the drawings and will be described in details herein a specific embodiment of a casket shipping package and some preferred components thereof, with the understanding that the present disclosure is to be considered as an example of the principles of the invention and is not intended to limit the invention to the embodiment illustrated.

In order to simplify the text of this specification, the words casket and casket kit are used herein to indicate a cardboard casket, a cremation box, a casket liner box, a body container or the like container made with foldable material and shippable to a purchaser in a flat form.

Figure 3:
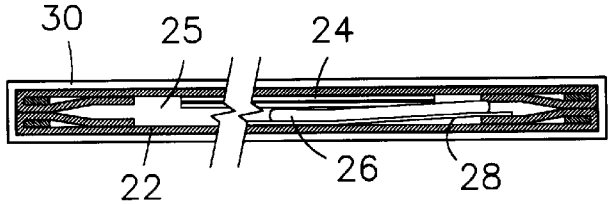
FIG. 3 is an enlarged partial cross-section view through the shipping package according to the preferred embodiment taken along line 3—3 in FIG. 1.
Figure 2:
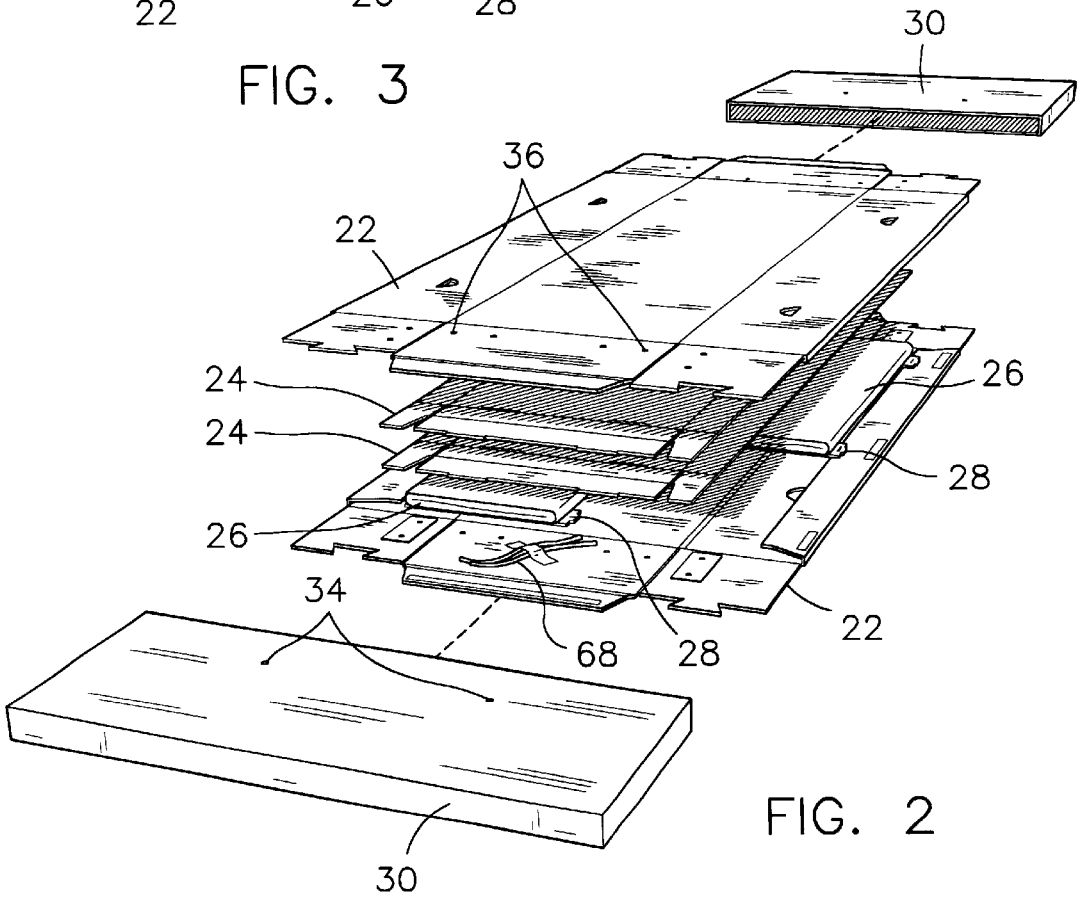
FIG. 2 is an exploded perspective view illustrating the shipping package according to the preferred embodiment of the present invention, and the casket kits comprised therein.

Reference is firstly made to FIGS. 1, 2 and 3, wherein there is illustrated a shipping package 20 according to the preferred embodiment of the present invention, comprising a pair of casket kits. Each casket kit includes a casket-base folder 22, a casket-cover folder 24, and a casket-interior liner cloth 26 which is pleated, pressed, stretched and maintained in a wrinkle-free condition by its attachment to a liner-cloth stretcher 28. The casket-base folders 22 are placed with their inside surfaces against each other, and enclose both casket-cover folders 24 and both casket-interior liner cloths 26. The shipping package 20 according to the preferred embodiment also comprises a pair of oblong boxes 30 enclosing both ends of the casket kits.

Each casket-base folder 22 has relatively stocky longitudinal edges as will be described later. Therefore, when both casket-base folders 22 are placed against each other, a hollow space 25 is defined therebetween. This hollow space 25 has sufficient thickness for fixedly enclosing the casket-cover folders 24, the casket-interior liner cloths 26 and other casket components which will be described later, and which are required for mounting a complete casket.

The liner-cloth stretchers 28 are attached by staples, clips or otherwise to the edge of one of the casket-base folders 22, in order to prevent relative movement of the liner cloths 26 within the shipping package during transport and handling of the shipping package. The use of these liner-cloth stretchers 28 is advantageous for ensuring that the interior liner cloths 26 are delivered to a funeral parlor in a wrinkle-free, out-of-the-laundry-room condition.

The oblong boxes 30 are secured to the casket-base folders 22 by strap members 32 which are respectively threaded through a first set of holes 34 through each oblong box 30, and through a second set of holes 36 through each casket-base folder 22.

The inside dimensions of the oblong boxes 30 are preferably selected such as to provide a precise fit over the casket-base folders 22. When the strap members 32 are installed and tightened in place, the casket-base folders 22 are securely held against each other for firmly clamping the casket-cover folders 24 and the casket-interior liner cloths 26 therebetween.

As will be appreciated, each of the casket-base folders 22 is foldable to form a casket base. Each of the casket-cover folders 24 is foldable to form a casket cover. Further details as to the folding of these folders 22 and 24 are not provided herein for being known to those skilled in the art of foldable cardboard casket kits.

As mentioned before, the shipping package 20 according to the preferred embodiment has stocky edges 38, the structure of which will be described later when making reference to FIG. 6, for resisting substantial bending stresses and affording a firm handling thereof. The shipping package 20 according to the preferred embodiment also has several handle openings 40 therein which are conveniently located along the stocky edges 38 for affording an easy manipulation of the shipping package by hand.

Although the illustrations in FIGS. 1, 2 and 3 show components for making one pair of caskets. It will be appreciated that a similar shipping package can be built for shipping components for making a larger quantity of caskets. Preferably, the shipping package includes folders for making two to six caskets such that it is still manipulable by hand.

Figure 4:
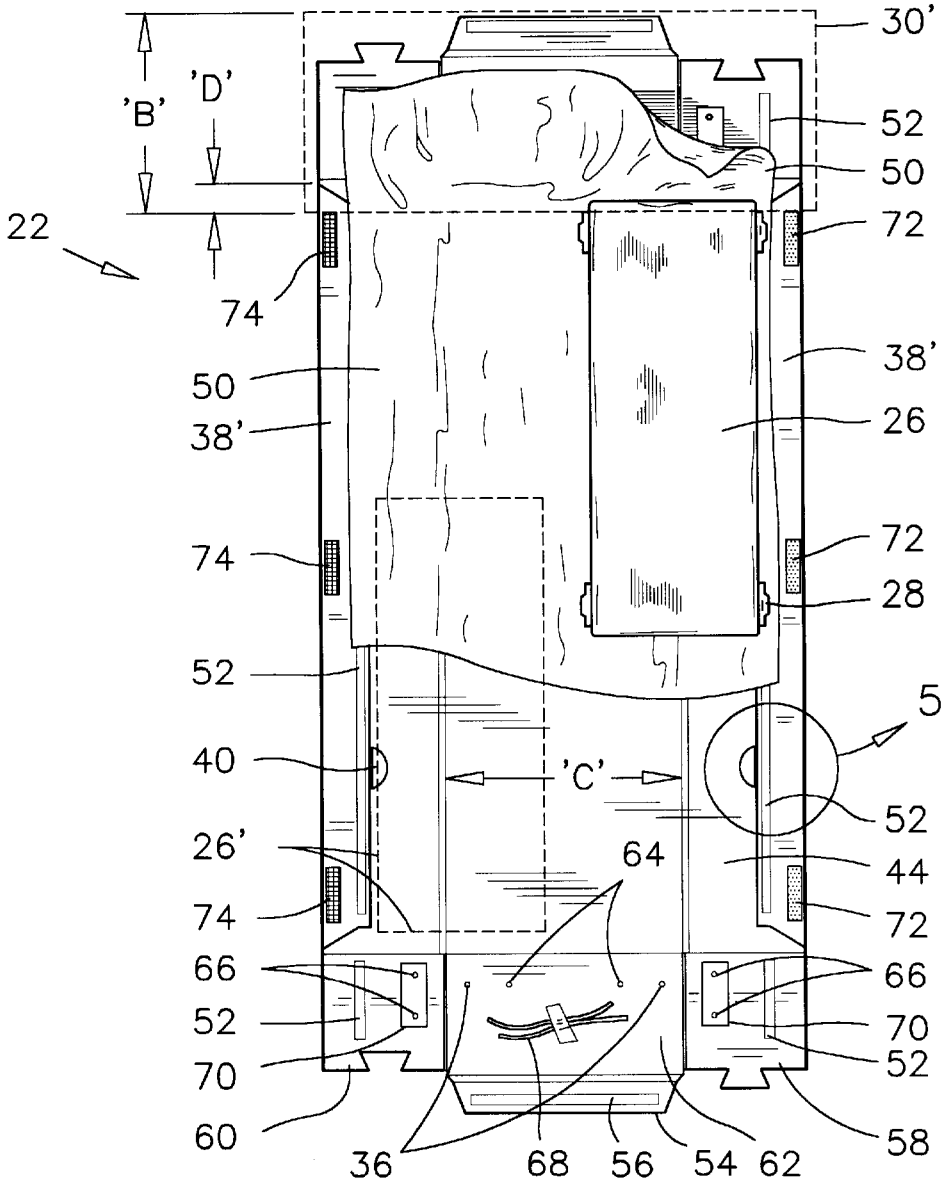
FIG. 4 illustrates a top plan view of a preferred casket-base folder comprised in the shipping package according to the preferred embodiment.
Figure 5:
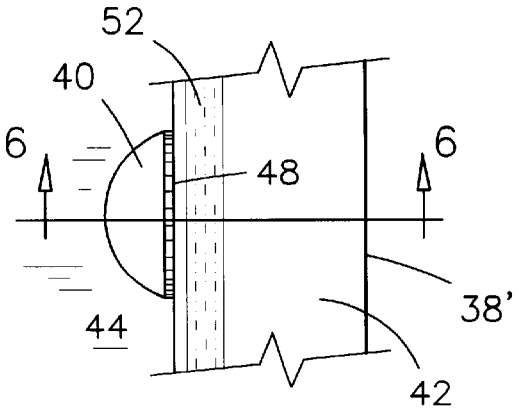
FIG. 5 is an enlarged plan view of a semicircular handle opening through the preferred casket-base folder, as seen in detail circle 5 in FIG. 4.
Figure 6:
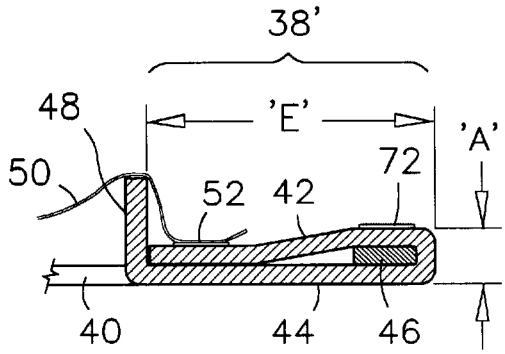
FIG. 6 is an enlarged cross-section view through the edge and handle structure of the preferred casket-base folder, as seen along line 6—6 in FIG. 5.

Referring now to FIGS. 4 to 6, the preferred casket-base folder 22 included in the shipping package 20 according to the preferred embodiment will be described in details. The preferred casket-base folder 22 has reinforced side edges 38' and semicircular handle openings 40 therein. Each reinforced edge 38' has a longitudinal portion 42 that is bent over the side section 44 and encloses a wood strip 46. The longitudinal portion 42 is glued to the side section 44.

The casket-base folder 22 is preferably made of two-ply corrugated board material having a thickness of about 5/16 inch (8 mm). The wood strip 46 has preferred dimensions of ¼ inch thick by one inch wide (6 mm ×25 mm) and extends the full effective length of the casket base to be formed. The resulting thickness 'A' of the reinforced stocky edge 38' is about ⅞ inch (22 mm) to provide substantial strength and stiffness to the casket-base folder 22 when the casket-base folder is assembled in the shipping package 20, and when it is folded up in its usable form.

Upon working of the casket kits into formed caskets, each oblong box 30 is preferably flattened and used as a reinforcing pad along the bottom surface of one of the formed caskets, in a manner which is known in the art. For this purpose, the longitudinal dimension 'B' of each oblong box 30 relative to the length of the shipping package 20 is preferably equal to or shorter than the inside width of a formed casket, that is, as the width 'C' of the central crease-free portion of the casket-base folder 22.

The longitudinal dimension of each oblong box 30 is also determined as to enclose a portion 'D' of at least one inch (25 mm) of the reinforced edge 38' on each end of a casket-base folder 22, such that the shipping package 20 is sturdy and can be manipulated by supporting it at any location along the perimeter thereof.

Each semicircular handle opening 40 is positioned with the straight edge thereof aligned along and bordering the longitudinal folded portion 42 of the reinforced edge 38'. The cut-out flap 48 of each handle opening 40 is foldable over the longitudinal portion 42 such that a manipulation of the casket-base folder 22 or of the shipping package 20 by these handle openings 40, provides a strong hold to prevent damage to the folders 22 or to the shipping package 20. It will be appreciated that the position of these semicircular handle openings 40 is also advantageous for handling the casket in use.

The preferred width 'E' of the reinforced edge 38' is between about 4–5 inches (102–127 mm). This dimension provides appropriate strength to the shipping package 20 and to the casket in use.

The preferred casket-base folder 22 has a plastic sheet or liner 50 attached to the interior surface thereof. This plastic sheet 50 is known in the field as a liquid retainer, and is only partly illustrated in FIG. 4 for maintaining the clarity of the drawing. The plastic liner 50 is preferably attached to the inside surface of the casket-base folder 22 by means of adhesive strips 52 applied on the inside surface and along the reinforced edges 38' of the casket-base folder 22.

Each end flap 54 also preferably has an adhesive strip 56 such that an assembly of the casket base is easily effected by folding the end flap 54 over the end segments 58 and 60 in a known manner for securing the end members 62 to the end segments. The adhesive strips 52 and 56 are preferably of the type having a protective peel-off tape thereon wherein the adhesive surface is exposed by removing the tape.

The strapping holes 36 form a set with handle holes 64 through the end member 62 for receiving cord-type handles. Other pairs of handle holes 66 through the end segments 58 and 60 are positioned to coincide with the holes 36 and 64 through the end member 62 when the casket is formed.

A pair of cord pieces 68 are preferably taped to the inside surface of each end member 62. Upon forming and assembly of a casket, these cord pieces 68 are conveniently inserted in the superimposed holes 64, 36 and 66 from the exterior of the formed casket. Knots are formed on each cord pieces 68 inside the formed casket to define a pair of handles (not shown) through each end wall of the formed casket. For increased strength, each pair of holes 66 is preferably lined with a stiff holed plate 70 which is glued to the inside surface of each of the end segments 58 and 60.

It will be appreciated that while only one end of the preferred casket-base folder 22 has been described hereinabove, both ends are symmetrical and similarly structured.

As mentioned before, the interior liner cloth 26 for one casket is pleated, stretched and retained to a liner-cloth stretcher 28, such that it remains in a wrinkle-free condition during the transport of the shipping package 20 from the manufacturing plant to the purchaser's establishment. The preferred cloth-liner stretcher 28 is stapled or similarly tied to the reinforced stocky edge 38'. The interior liner cloth for the other casket in the pair of casket kits contained in the shipping package 20 is preferably tied to the reinforced edge 38' on the opposite side of the same casket-base folder 22. The interior liner cloth for the other casket is preferably tied to the opposite edge 38', in a mirrored position relative to the position of the first liner cloth 26, and relative to the longitudinal and transversal axes (not shown) of the casket-base folder 22, as illustrated in dashed lines 26' in FIG. 4. The attachment of both casket-interior cloths 26, 26' to the same casket-base folder is advantageous for affording an attachment of these casket-interior cloths when the casket-base folder is in a flat position. As will be appreciated, this attachment is advantageous for obviating the need for turning one of the liner cloths upside down during the assembling of the shipping package 20 according to the preferred embodiment, to prevent ruffling of the cloths during the final assembly of the shipping package 20.

Each casket-base folder 22 has strips of Velcro™ fasteners 72 and 74 which are provided along the inside surfaces of the reinforced stocky edges 38'. During the forming of a delivered casket, the interior liner cloth 26 is preferably unfolded and attached to these strip fasteners 72, 74 in a known manner.

The strip fasteners 72 on one side of the casket-base folder 22 are preferably of a gripping type, and the strip fasteners 74 on the other side of the casket-base folder 22 are preferably of a mating type, or vice-versa. Therefore, when the two casket-base folders 22 are placed against each other, with their inside surfaces facing each other, the mating strips 72 on one casket-base folder mates with the gripping strips 74 on the other folder to retain both casket-base folders against each other. It will be appreciated that the complete shipping package 20 formed thereby has stiff laminated-like edges 38 for providing substantial strength and support surface to resist a firm handling thereof.

The strip fasteners 72, 74 are also advantageous for retaining a pair of casket-base folders 22 together during an intermediate packaging process, wherein the casket-cover folders 24 and the liner cloths 26 are retained therebetween in a fixed manner. The pair of casket-base folders 22 are thereby easily manipulable during the assembling of the shipping package 20, for installing and securing the oblong boxes 30 thereon for example.

Figure 7:
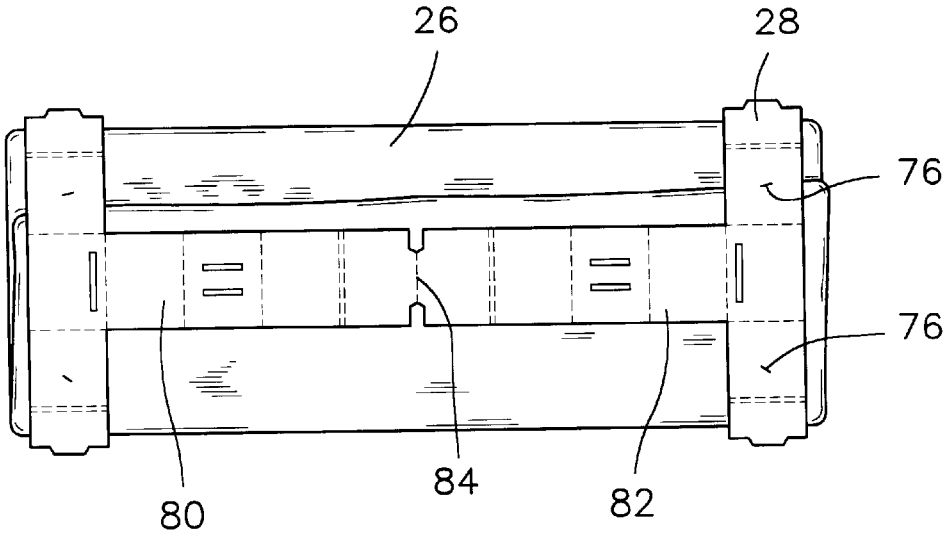
FIG. 7 is an underside view of the preferred liner-cloth stretcher used to retain the casket-interior liner cloth is a pleated, stretched and wrinkle-free condition inside the shipping package according to the preferred embodiment.
Figure 8:
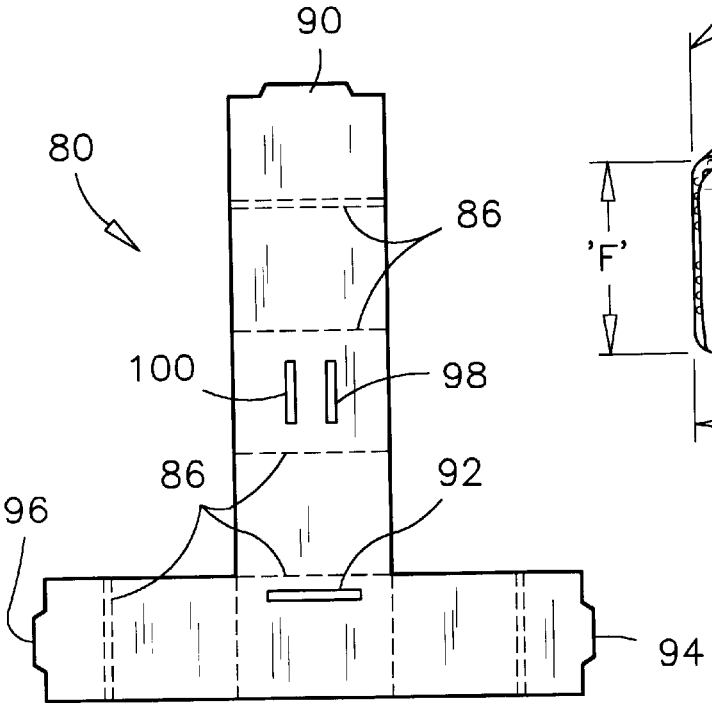
FIG. 8 illustrates an enlarged top plan view of a T-like segment of the preferred liner-cloth stretcher shown in FIG. 7.
Figure 9:
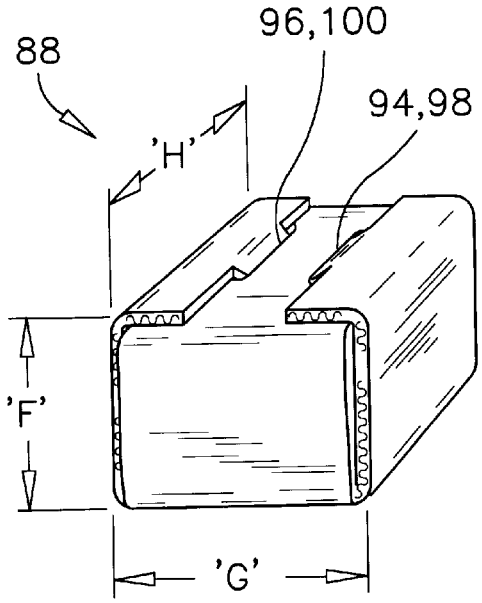
FIG. 9 illustrates the T-like segment of the preferred liner-cloth stretcher as shown in FIG. 8, which has been folded over itself, and forms a multi-dimensional corpse positioning and supporting member.

Referring now to FIGS. 7 to 9, there will be described an important feature of the preferred liner-cloth stretcher 28. As it was mentioned before, the interior liner cloth 26 is retained to a liner-cloth stretcher 28 such that it is kept in a wrinkle-free condition until the casket kit is delivered to the purchaser. The liner cloth 26 is preferably retained to the liner-cloth stretcher 28 by means of threads, pins or plastic ties 76 such as those used in garment packaging for example.

The preferred liner-cloth stretcher 28 is made of single-ply corrugated board. The preferred liner-cloth stretcher 28 is made of two symmetrical halves or T-like segments 80, 82, which are joined at their bases in a separable manner along a perforated line 84. Each T-segment, 80 for example, is foldable along several dotted lines 86 to form a corpse positioning and supporting member 88 which is conveniently usable for supporting the elbow or the head of an exposed corpse. Each liner-cloth stretcher 28 is thereby usable for making a pair of corpse positioning and supporting members 88, as those are generally needed in pairs in each casket.

Tabs and slots are preferably provided on each of the T-segments 80, 82 for securing each T-segment in a folded block-like form without adhesive. For example, tab 90 is preferably adapted for engagement with slot 92, and the tabs 94 and 96 are preferably adapted for engagement into the slots 98 and 100 respectively.

The preferred dimensions for each liner-cloth stretcher 28 are selected to form a multi-dimensional corpse supporting and positioning member 88 which can be used in different orientations for supporting a corpse portion at different levels. Examples of preferred dimensions for the corpse supporting and positioning member 88 are: a height 'F' of about 3–4 inches (7.6–10 cm), a width 'G' of about 4–5 inches (10–12 cm), and a length 'H' of about 5–6 inches (12–15 cm). These dimensions have been found to be convenient for the intended purpose of the article. This liner-cloth stretcher 28 is also made with combustible material and is usable in the final product in order to reduce waste associated with the use of the preferred shipping package 20.

As will be appreciated from the above, the casket-base folder 22, the casket-cover folder 24, the plastic liner 50, the cord pieces 68, the liner cloth 26 and the liner-cloth stretcher 28 cooperatively form a selfcontained casket kit which is easily assembled without any additional material, tool or jig. The forming of a casket with the casket kit described herein requires minimal instructions and does not generate any waste other than a pair of strapping members 32.

As to other manners of usage and operation of the shipping package 20 according to the present invention or to other manners of assembling the preferred casket folders 22 or corpse supporting and positioning members 88 contained in the shipping package 20, the same should be apparent from the above description and accompanying drawings, and accordingly, further discussion relative to these aspects would be considered redundant and is not provided.

While one embodiment of the present invention has been illustrated in the accompanying drawings and described hereinabove, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

We claim:

1. A shipping package for casket folders, comprising:

first and second casket-base folders each having a length, a width, an inside side, an outside side, opposite end portions and stocky edges bordering said inside side and extending between said opposite end portions along said length; said first and second casket-base folders being positioned against each other with said inside sides facing each other and with said stocky edges of said first casket-base folder being juxtaposed and aligned with said stocky edges of said second casket-base folder, said stocky edges and said inside sides of said first and second casket-base folders defining a hollow space;

a pair of casket-cover folders enclosed in said hollow space; and a pair of pleated casket-interior liner cloths affixed to said first casket-base folder and being tightly enclosed in said hollow space; and a pair of oblong boxes respectively enclosing one of said opposite end portions of said first and second casket-base folders;

such that said first and second casket-base folders, said pair of casket-cover folders and said pair of casket-interior liner cloths are shippable to a purchaser's establishment while maintaining a manufacturer's quality thereof.

2. The shipping package as claimed in claim 1, wherein each of said stocky edges comprises two layers of double-ply corrugated board folded over a wood strip having a thickness of about ¼ inch.

3. The shipping package as claimed in claim 2, wherein each of said stocky edges has a transversal dimension of between about 4 inches to about 5 inches.

4. The shipping package as claimed in claim 3, wherein said oblong boxes also enclose portions of said stocky edges.

5. The shipping package as claimed in claim 4, wherein each of said first and second casket-base folders also comprise semicircular handle openings therein, and each of said semicircular handle openings has a straight segment bordering one of said stocky edges.

6. The shipping package as claimed in claim 3, further comprising strips of mating and gripping material on said stocky edges for retaining said stocky edges of said first casket-base folder to said stocky edges of said second casket-base folder.

7. The shipping package as claimed in claim 1, further comprising a pair of liner-cloth stretchers respectively affixed to one of said casket-interior liner cloths for maintaining said casket-interior liner cloths in a wrinkle-free condition.

8. The shipping package as claimed in claim 1, further comprising strap members through said oblong boxes and through said opposite end portions for fixedly retaining said oblong boxes to said first and second casket-base folders and for retaining said first and second casket-base folders against each other.

9. The shipping package as claimed in claim 1, wherein each of said first and second casket-base folders has a central crease-free portion having a bottom width, and each of said oblong boxes has a longitudinal dimension relative to said shipping package, and said longitudinal dimension is equal to or smaller than said bottom width.

10. A package of casket kits for shipment to a purchaser, comprising:

first and second casket-base folders each having a length, a width, an inside surface, an outside surface and opposite ends, said inside surface of said first casket-base folder facing said inside surface of said second casket-base folder;

a pair of casket-cover folders enclosed between said first and second casket-base folders;

a pair of liner-cloth stretchers attached to said inside surface of said first casket-base folder;

a pair of pleated casket-interior liner cloths respectively attached to one of said liner-cloth stretchers;

a pair of oblong boxes respectively enclosing one of said opposite ends; and means for retaining said oblong boxes to said first and second casket-base folders and for holding said first and second casket-base folders against each other;

such that said casket-interior liner cloths are maintainable in a pleated, wrinkle-free condition during transport thereof to the purchaser.

11. The package of casket kits as claimed in claim 10, wherein said casket-interior liner cloths are retained to said first casket-base folder in mirrored positions relative to each other and to longitudinal and transversal dimensions of said first casket-base folder.

12. The package of casket kits as claimed in claim 11, wherein each of said first and second casket-base folders has stocky edges extending between said opposite ends.

13. The package of casket kits as claimed in claim 12, wherein each of said stocky edges comprises two layers of double-ply corrugated board enclosing a wood strip.

14. The package of casket kits as claimed in claim 13, wherein each of said stocky edges has a thickness of about ⅞ inch and a width of between about 4 inches to about 5 inches.

15. The package of casket kits as claimed in claim 14, further comprising engaging gripping and mating fasteners along said stocky edges for further holding said first and second casket-base folders against each other.

16. The package of casket kits as claimed in claim 14, wherein said oblong boxes enclose portions of said stocky edges.

17. The package of casket kits as claimed in claim 10, wherein each of said opposite ends has a first set of holes therein, and each of said oblong boxes has a second set of holes therein aligning with said first set of holes, and said means for retaining said oblong boxes comprises a strap threaded through said first and second set of holes.

18. A shipping package for casket folders, comprising:

a pair of casket-base folders each having a length, a width, an inside side, an outside side, opposite end portions and stocky edges bordering said inside side and extending between said opposite end portions along said length; said casket-base folders being positioned against each other with said inside sides facing each other;

a pair of casket-cover folders tightly enclosed between said casket-base folders;

a pair of liner-cloth stretchers attached to said inside side of one of said casket-base folders;

a pair of pleated casket-interior liner-cloths affixed to said liner-cloth stretchers;

said pair of liner-cloth stretchers and said pair of casket-interior liner cloths being tightly enclosed between said casket-base folders, and means for tightly retaining said pair of casket-base folders to each other;

such that said pair of casket-base folders, said pair of casket-cover folders and said pair of casket-interior liner cloths are shippable to a purchaser's establishment while maintaining a manufacturer's quality thereof.

19. The shipping package as claimed in claim 18, wherein each of said liner-cloth stretchers is made of single-ply corrugated board material and has two symmetrical segments detachably connected to each other, and each of said segments has means to afford a folding thereof into an alternate form usable as a casket accessory.

20. The shipping package as claimed in claim 19, wherein each of said symmetrical segments is T-shaped and has slots, tabs and bending lines to afford a folding thereof into a multi-dimensional corpse supporting and positioning block.

* * * * *